US006959462B2

(12) United States Patent
Chen

(10) Patent No.: US 6,959,462 B2
(45) Date of Patent: Nov. 1, 2005

(54) BASSINET HAVING AN ACCOMMODATING SPACE

(75) Inventor: Shun-Min Chen, Taipei Hsien (TW)

(73) Assignee: Wonderland Nurserygoods, Co., Ltd., (TW)

( * ) Notice: Subject to any disclaimer, the term of this patent is extended or adjusted under 35 U.S.C. 154(b) by 0 days.

(21) Appl. No.: 10/827,037

(22) Filed: Apr. 19, 2004

(65) Prior Publication Data

US 2005/0144716 A1 Jul. 7, 2005

(30) Foreign Application Priority Data

Jan. 6, 2004 (CN) ..... 2004-200015032

(51) Int. Cl.[7] ..... A47D 7/00; A47D 13/06
(52) U.S. Cl. ..... 5/93.1; 5/97; 5/98.1
(58) Field of Search ..... 5/93.1, 97, 98.1, 5/99.1, 655

(56) References Cited

U.S. PATENT DOCUMENTS

| | | | | | |
|---|---|---|---|---|---|
| 2,280,913 | A | * | 4/1942 | Hummel et al. | 5/2.1 |
| 2,537,539 | A | * | 1/1951 | McLendon et al. | 5/95 |
| 2,654,098 | A | * | 10/1953 | Heyward | 5/2.1 |
| 2,686,922 | A | * | 8/1954 | La Vigne | 5/93.1 |
| 2,752,614 | A | * | 7/1956 | Hayward | 5/93.1 |
| 3,487,479 | A | * | 1/1970 | Grooms | 5/93.1 |
| 3,631,547 | A | * | 1/1972 | Massie | 5/93.1 |
| 4,302,857 | A | * | 12/1981 | Kodet et al. | 5/2.1 |
| D351,756 | S | * | 10/1994 | Miller et al. | D6/611 |
| 5,813,064 | A | * | 9/1998 | Hartenstine | 5/99.1 |
| D429,929 | S | * | 8/2000 | Benson | D6/503 |
| 6,192,535 | B1 | * | 2/2001 | Warner et al. | 5/93.1 |
| 6,539,563 | B1 | * | 4/2003 | Hsia | 5/93.2 |
| 6,588,033 | B1 | * | 7/2003 | Welsh et al. | 5/99.1 |
| 6,687,927 | B1 | * | 2/2004 | Tharalson et al. | 5/98.1 |
| 6,704,949 | B2 | * | 3/2004 | Waldman et al. | 5/93.1 |
| 2003/0070230 | A1 | * | 4/2003 | Hsia | 5/95 |
| 2003/0177574 | A1 | * | 9/2003 | Waldman | 5/93.1 |
| 2004/0074000 | A1 | * | 4/2004 | Tharalson et al. | 5/99.1 |

FOREIGN PATENT DOCUMENTS

| | | |
|---|---|---|
| TW | 373479 | 2/1988 |

OTHER PUBLICATIONS

English-language Abstract of Taiwanese Patent Publication No. 373479.

* cited by examiner

*Primary Examiner*—Robert G. Santos
(74) *Attorney, Agent, or Firm*—Scully, Scott, Murphy & Presser

(57) ABSTRACT

A bassinet having an accommodating space is provided. The bassinet can be supported on a baby play yard and has an accommodating portion. The accommodating portion is connected to the underneath of the bassinet and configured to define an accommodating space for receiving articles. A side face of the baby play yard is provided with an opening, so that it is convenient for a user to take out the articles received in the accommodating space. As a result, when necessary, the user just squats down, opens the opening on the side face, and thus can take out the articles very easily.

5 Claims, 3 Drawing Sheets

BASSINET HAVING AN ACCOMMODATING SPACE

FIELD OF INVENTION

The present invention relates to a bassinet supported on a baby play yard, and more particularly, to a bassinet having an accommodating space.

BACKGROUND OF THE INVENTION

Many kinds of bassinet structures are already well known (as shown in FIG. 1) and most of them are in the form of a rectangular construction. A baby can lie on such kind of bassinet and be taken care by his parents or babysitter. However, among the existing bassinet structures, only one sleeping space is provided on the bassinet but no further accommodating space. Since there are plenty of articles necessary for a baby, such as feeding bottle, diapers, towels, clothes, toys or the like, there is a shortcoming in having insufficient space for accommodating these articles when using the above kind of bassinet.

As a result, some other kinds of bassinets have been proposed, in which the necessaries for the baby can be disposed in a space beneath the bassinet. Specially, the space is formed between the bassinet and the baby play yard. For example, Taiwan Patent Publication No.:373479 discloses a bassinet (as shown in FIG. 1), in which a bottom of the bassinet is provided with inner bottom holes (29) for forming an access for taking and putting the articles. When a user wants to take the articles under the bassinet, he/she needs to lift a plate of a foldable bedplate (293), and stretches out his/her hand to get the articles.

However, the bassinet structure disclosed in the above document is still inconvenient. Since the user should lift the foldable bedplate (293) first and then stretch his/her hand into the inner bottom hole (29) to get the articles in the bottom of the baby play yard, when a baby is lying on the bassinet, the user should overcome the weight of the baby or move the baby away so that he/she may lift the bedplate. Further, the user should bend his/her back to stretch his/her hand to the bottom of the baby play yard so that he/she could get the articles, which is very inconvenient in use. On the other hand, since there is no compartment in the space formed between the bassinet and the baby play yard, all the articles can only be disposed in the bottom of the frame. As a result, the efficiency of utilizing the space is low and the articles often get disordered and collapsed. Hence, there is really a need for an improved bassinet capable of accommodating articles and easily taking the articles out.

SUMMARY OF THE INVENTION

In view of the above drawbacks of conventional bassinets, the present invention is achieved by the diligence and experience of the applicant. The object of this invention is to provide an improved bassinet having an accommodating space, which is adapted for accommodating articles and easily taking the articles out.

According to one aspect of this invention, a bassinet having an accommodating space is provided. The bassinet can be supported on a baby play yard and has an accommodating portion. The accommodating portion is connected to the underneath of the bassinet and configured to define an accommodating space for receiving articles. A side face of the baby play yard is provided with an opening for a user to take out the articles received in the accommodating space.

As a result, when necessary, the user just squats down, opens the opening on the side face of the baby yard, and thus can take out the articles very easily.

With the above arrangement, the bassinet having an accommodating space according to this invention has the following advantages. The user can easily take the articles from the accommodating portion under the bassinet even a baby lies on the bassinet. Further, since the accommodating portion is divided into several compartments, the disorder and collapse of the articles can be significantly reduced.

BRIEF DESCRIPTION OF THE DRAWINGS

The structure, features and functions of this invention will be described in detail with reference to the following description together with the accompany drawings, in which.

DETAILED DESCRIPTION OF THE PREFERRED EMBODIMENT

This invention will be described with reference to the accompany drawings.

Figure 1:
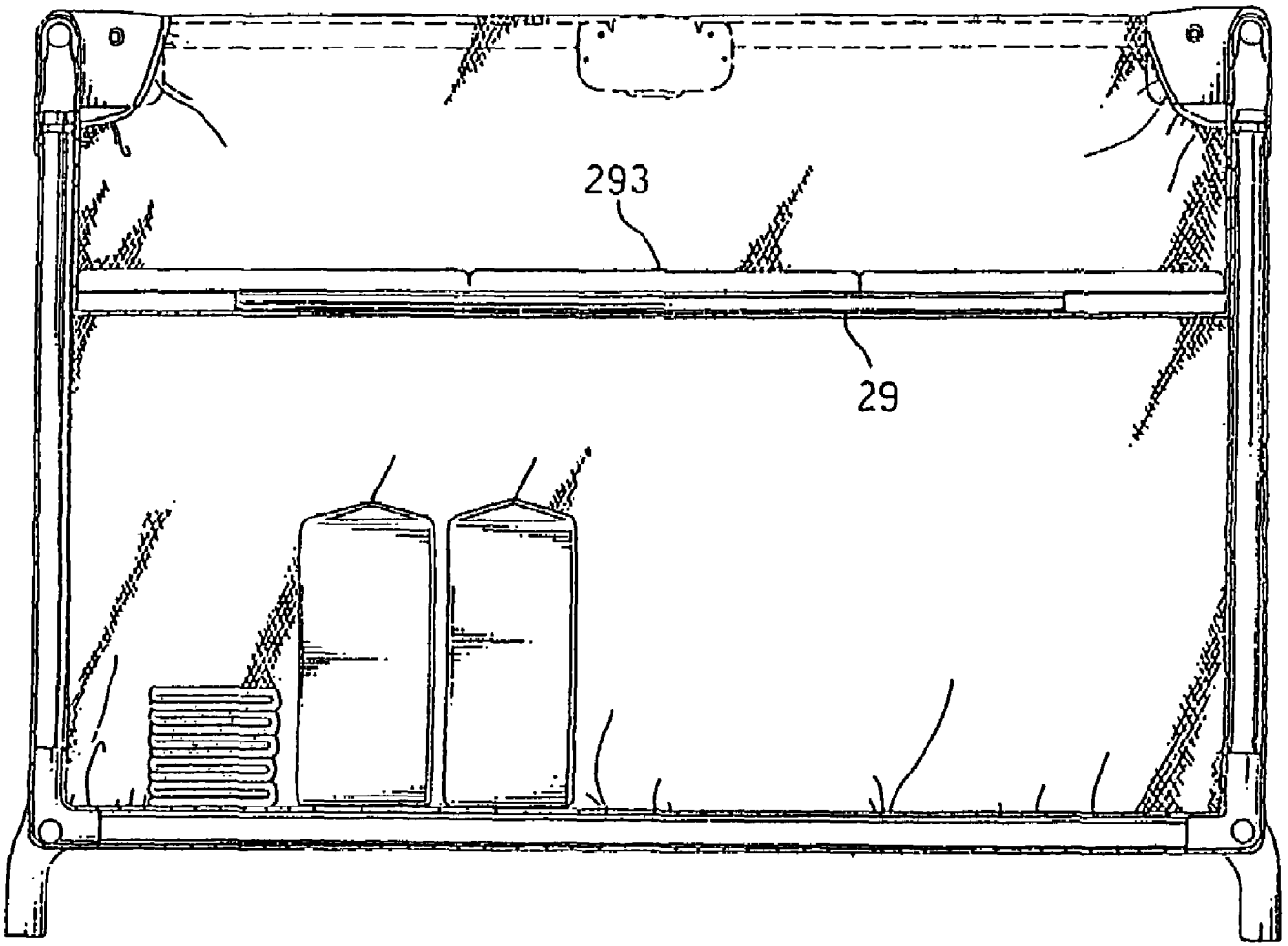
FIG. 1 is a schematic front view showing a conventional bassinet supported on a baby play yard, in which the bassinet is not provided with any compartments for storing articles.
Figure 2:
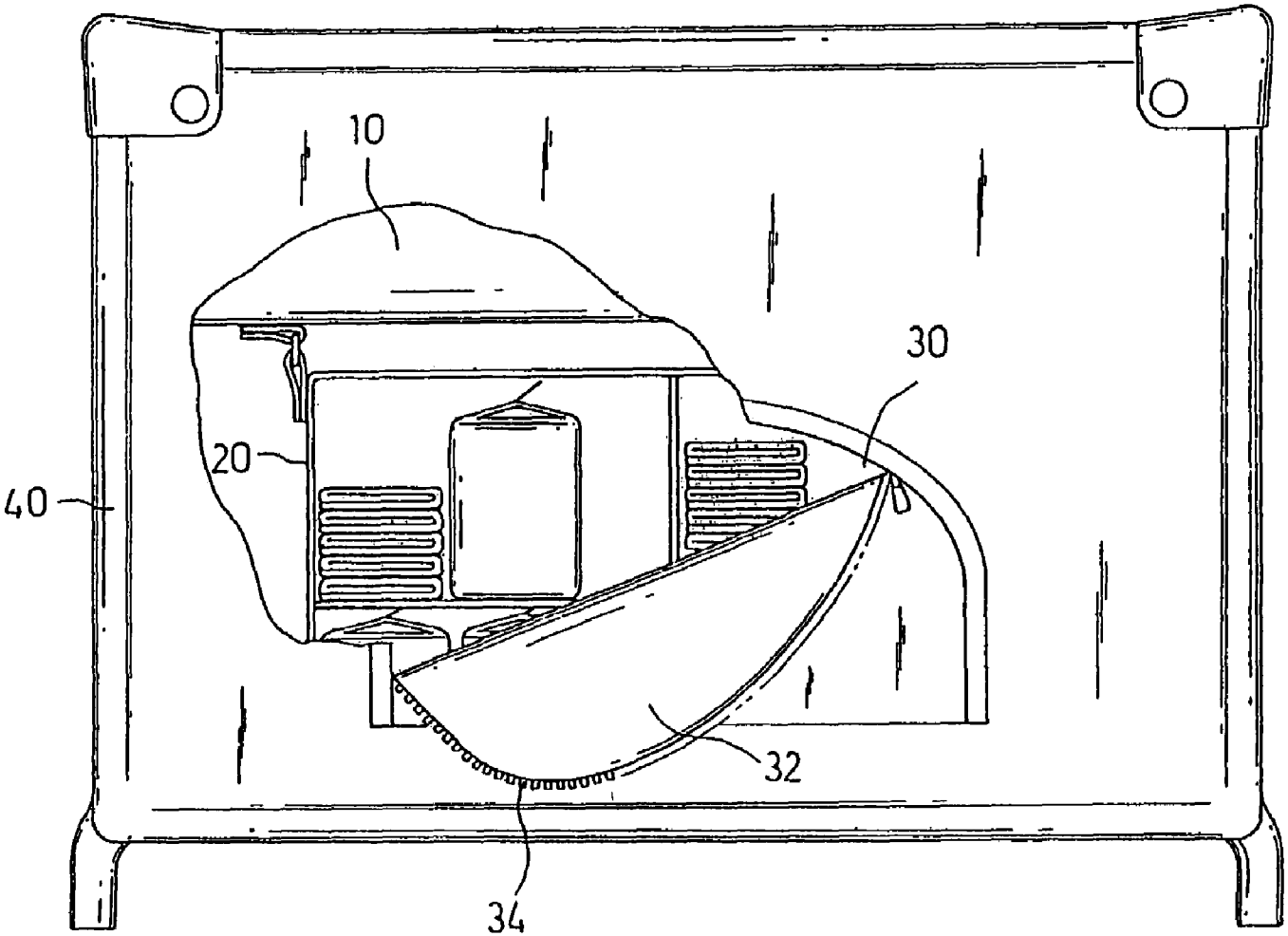
FIG. 2 is a schematic front view showing the bassinet of this invention supported on a baby play yard.

As shown in FIG. 2, according to one aspect of this invention, a bassinet 10 having an accommodating space is provided. The bassinet 10 can be supported on a baby play yard 40 and has an accommodating portion 20. The accommodating portion 20 is connected to the underneath of the bassinet 10 and configured to define an accommodating space for receiving articles. With the above arrangement, a user can put the necessaries of a baby in the accommodating portion 20 between the bassinet 10 and the bottom of the baby play yard 40.

A side face of the baby play yard 40 is provided with a semicircular opening 30 at a position corresponding to the accommodating portion 20, so that it is convenient for a user to take out the articles received in the accommodating space 20. Further, a semicircular cover 32 is provided on the semicircular opening 30. Between the periphery of the semicircular cover 32 and the inner edge of the opening 30, a zipper 34 is provided for easily opening and closing the opening 30. Certainly, in addition to the zipper 34, a connecting means such as Velcro, button, hook or the like can be used. When the user wants to get the articles in the accommodating portion 20, he/she just squats down and opens the opening 30 on the side face of the baby play yard 40, and thus the articles can be easily taken out without lifting the bassinet 10. Such an operation is very convenient.

Figure 3:
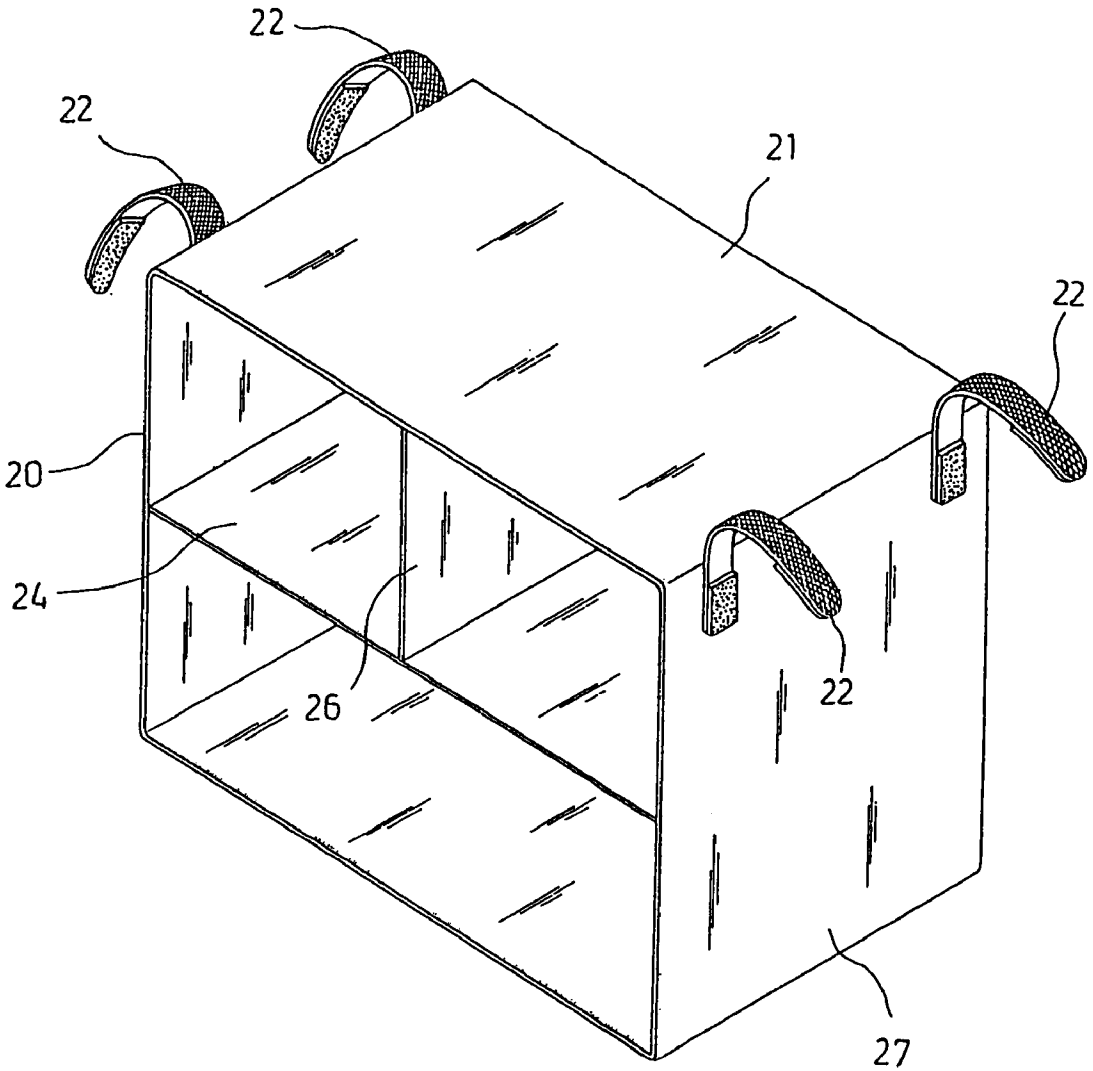
FIG. 3 is a schematic perspective view showing the accommodating portion of the bassinet of this invention.

As shown in FIG. 3, a preferred embodiment of the accommodating portion 20 is substantially formed as a rectangular parallelepiped. Four corners of a top face 21 of the accommodating portion 20 are provided with fixing means 22 for fixing the accommodating portion 20 underneath the bassinet 10. The fixing means 22 can be adapted to any suitable forms, such as Velcro, button, hook, zipper or the like. Certainly, according to the type of the fixing means 22, associated fixing means should also be provided beneath the bassinet 10 for securely fixing the accommodating portion 20 underneath the bassinet 10.

The accommodating portion 20 is provided with partitions 24, 26 made of wood, plastic or PP corrugated plate. The partitions are used to support and define the main shape of the accommodating portion 20. The side face 27 of the accommodating portion 20 can be made from a layer of softer cloth. As shown in FIG. 3, a double-decked accommodating portion 20 can be made by inserting a horizontal partition 24 and a vertical partition 26 to form three compartments. Certainly, there are still various modifications on the arrangement of the partitions of the accommodating portion 20.

With the above arrangement, the bassinet having an accommodating space according to this invention has the following advantages. The user can easily take the articles from the accommodating portion 20 under the bassinet 10 even a baby lies on the bassinet. Further, since the accommodating portion 20 is divided into several compartments, the disorder and collapse of the articles can be significantly reduced. Moreover, this invention is simple in structure and will not have an influence on the cost or price. Therefore, most customers will prefer this invention due to its multiple functions and inexpensive price.

While this invention has been described by the above embodiments, it should be understood that this invention is not limited to this. Various modifications can be easily thought of by those skilled in this art in view of the teaching of this invention. Therefore, as long as not departing from the spirit of this invention, such simple modification or equivalent change still falls in the scope of this invention defined by the appended claims.

LIST REFERENCE NUMERALS OF PRIMARY ELEMENTS

10 bassinet
20 accommodating portion
21 top face
22 fixing means
24, 26 partition
27 side face
30 opening
32 cover
34 zipper
40 play yard
29 inner bottom hole
293 bedplate

What is claimed is:

1. A bassinet for a baby play yard which is enclosed by a fabric, comprising an accommodating portion configured to define an accommodating space for receiving articles, wherein the bassinet is supported on the play yard, the accommodating space is suspended by and positioned beneath the bassinet, the accommodating portion is provided with fixing means for securely fixing the accommodating portion under the bassinet, an opening is provided on the play yard at a position corresponding to the accommodating portion so that the articles received in the accommodating portion are accessible by a user, the opening is provided with a cover thereon, and at least one fastening means is provided between the periphery of the cover and the inner edge of the opening.

2. The bassinet according to claim 1, wherein the fastening means is a hook and loop fastener, such as the one sold under the trademark of Velcro, a hook, a button, or a zipper.

3. The bassinet according to claim 1, wherein the fixing means for securely fixing the accommodating portion under the bassinet is a hook and loop fastener, such as the one sold under the trademark of Velcro, a button, a hook, or a zipper.

4. The bassinet according to claim 1, wherein the accommodating portion is substantially formed as a rectangular parallelepiped.

5. The bassinet according to claim 1 or 4, wherein the accommodating portion is provided with at least one partition for dividing the interior of the accommodating portion into a plurality of compartments for receiving articles.

* * * * *